US011174604B1

(12) United States Patent
Johnson et al.

(10) Patent No.: US 11,174,604 B1
(45) Date of Patent: Nov. 16, 2021

(54) MILLING SYSTEMS AND METHODS FOR A MILLING MACHINE

(71) Applicant: Caterpillar Paving Products Inc., Brooklyn Park, MN (US)

(72) Inventors: Nicholas B. Johnson, Dayton, MN (US); Eric S. Engelmann, Delano, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/928,053

(22) Filed: Jul. 14, 2020

(51) Int. Cl.

| | |
|---|---|
| ***B28D 1/18*** | (2006.01) |
| ***E01C 23/12*** | (2006.01) |
| ***E01C 23/088*** | (2006.01) |
| ***E21C 35/19*** | (2006.01) |
| ***E21C 35/197*** | (2006.01) |

(52) U.S. Cl.
CPC ..... *E01C 23/088* (2013.01); *B28D 1/188* (2013.01); *E01C 23/127* (2013.01); *E21C 35/19* (2013.01); *E21C 35/191* (2020.05); *E21C 35/197* (2013.01)

(58) Field of Classification Search
CPC ..... E21C 35/18; E21C 35/19; E21C 35/191; E21C 35/193; E21C 35/1933; E21C 35/1936; E21C 35/197; E21C 27/24; E21C 25/10; E21C 35/188; E01C 23/088; E01C 23/127; B28D 1/188
See application file for complete search history.

(56) References Cited

U.S. PATENT DOCUMENTS

| | | | | |
|---|---|---|---|---|
| 4,195,946 | A * | 4/1980 | Swisher, Jr. | E01C 11/005 404/75 |
| 4,915,454 | A * | 4/1990 | Southern | E21C 35/187 299/108 |
| 5,106,166 | A * | 4/1992 | O'Neill | E21C 35/197 299/104 |
| 5,474,397 | A * | 12/1995 | Lyons | E01C 23/088 299/39.5 |
| 7,438,364 | B2 | 10/2008 | Boehme et al. | |
| 8,365,845 | B2 | 2/2013 | Hall et al. | |
| 8,960,337 | B2 | 2/2015 | Hall et al. | |
| 9,909,417 | B2 | 3/2018 | Hall et al. | |
| 2004/0145232 | A1* | 7/2004 | Sansone | B28D 1/188 299/39.8 |
| 2006/0255649 | A1* | 11/2006 | Dawood | E21C 35/18 299/87.1 |
| 2009/0261646 | A1* | 10/2009 | Ritchey | B28D 1/188 299/106 |
| 2010/0038955 | A1* | 2/2010 | Keller | E21C 35/18 299/102 |

(Continued)

FOREIGN PATENT DOCUMENTS

| | | | |
|---|---|---|---|
| CN | 106441870 | A | 2/2017 |
| JP | 3457561 | B2 | 10/2003 |

*Primary Examiner* — Janine M Kreck
*Assistant Examiner* — Michael A Goodwin

(57) ABSTRACT

A method of adjusting milling properties of a rotor for a milling machine includes accessing the rotor. The rotor includes a drum and a plurality of cutting assemblies, and each cutting assembly includes a tool block, a tool holder, and a cutting bit. The method also includes adjusting a rotational orientation of a plurality of cutting bits and tool holders relative to the corresponding tool blocks, and enclosing the rotor.

21 Claims, 3 Drawing Sheets

(56) References Cited

U.S. PATENT DOCUMENTS

2011/0266861 A1* 11/2011 Hall ..... E21B 10/36
299/113
2016/0186392 A1* 6/2016 Mahlberg ..... E01C 23/088
299/1.5
2018/0328174 A1 11/2018 Magee et al.

* cited by examiner

MILLING SYSTEMS AND METHODS FOR A MILLING MACHINE

TECHNICAL FIELD

The present disclosure relates generally to a milling machine, and more particularly, to milling systems and methods for a milling machine.

BACKGROUND

The present invention relates to milling machines that are used in road surface repairs. Milling machines are typically utilized to remove a layer or layers of old or defective road surface in preparation for resurfacing. Machines, such as cold planers, rotary mixers, and other milling machines, are used for scarifying, removing, mixing, or reclaiming material from ground surfaces, such as, grounds, roadbeds, and the like. Such machines include a rotor enclosed within a rotor chamber. The rotor includes a cylindrical shell member and a number of cutting assemblies mounted on the shell member. When the machine is performing a cutting operation, cutting bits of the cutting assemblies impact the surface and break it apart. Thus, the cutting assemblies are arranged to cut the surface and to leave a milled surface that meets a known texture requirement. Another function of the cutting assemblies is to form an auger that moves material within the rotor chamber to a central area of the rotor chamber from where it can be moved by a conveyor to a truck. In these aspects, the arrangement and/or pitch of the cutting assemblies may affect the cutting operation, including, for example, the resulting texture and/or roughness of the resulting milled surface.

Chinese Patent No. 106441870A, issued to He et al. on Sep. 24, 2019 ("the '870 patent"), describes a milling rotor simulation and test device. The device of the '870 patent includes rotary mounting body and a cutter holder mounted on the rotary mounting body, and the cutter holder is configured to hold a cutter. The cutter holder is adjustable to adjust the angle of the cutter. However, the device of the '870 patent may not provide sufficient adjustment or control of a milling device. The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a method of adjusting milling properties of a rotor for a milling machine may include accessing the rotor. The rotor may include a drum and a plurality of cutting assemblies, and each cutting assembly may include a tool block, a tool holder, and a cutting bit. The method also may include adjusting a rotational orientation of a plurality of cutting bits and tool holders relative to the corresponding tool blocks, and enclosing the rotor.

In another aspect, a milling system for a milling machine may include a rotor including a drum and a plurality of cutting assemblies coupled to the drum. Each of the cutting assemblies may include a tool block, a tool holder, and a cutting bit. The cutting bits between adjacent cutting assemblies may be spaced apart by a pitch. The pitch may be adjustable between at least a first configuration and a second configuration by adjusting a rotational orientation of one or more of the tool holder or the cutting bit relative to the tool block.

In yet another aspect, a method of adjusting milling properties of a rotor for a milling machine may include accessing the rotor. The rotor may include a drum and a plurality of cutting assemblies. Each cutting assembly may include a tool block, a tool holder, and a cutting bit. The method may also include adjusting a rotational orientation of a plurality of cutting bits relative to the corresponding tool blocks, and enclosing the rotor.

In a further aspect, a milling system for a milling machine may include a rotor including a drum, and a plurality of cutting assemblies. Each of the cutting assemblies may include a tool block, a tool holder, and a cutting bit. With the cutting assemblies coupled to the drum, the cutting bits between adjacent cutting assemblies may be spaced apart by a pitch. The pitch may be adjustable between at least a first configuration and a second configuration, wherein one of the first configuration or the second configuration includes a pitch of zero.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or can be milled in the removal or formation of roadways. In this disclosure, relative terms, such as, for example, "about," "substantially," and "approximately," are used to indicate a possible variation of ±10% in a stated value. Although the current disclosure is described with reference to a milling machine, this is only exemplary. In general, the current disclosure can be applied as to any machine, such as, for example, a cold planer, rotary mixer, reclaimer, or another milling-type machine, known in the art.

Figure 1:
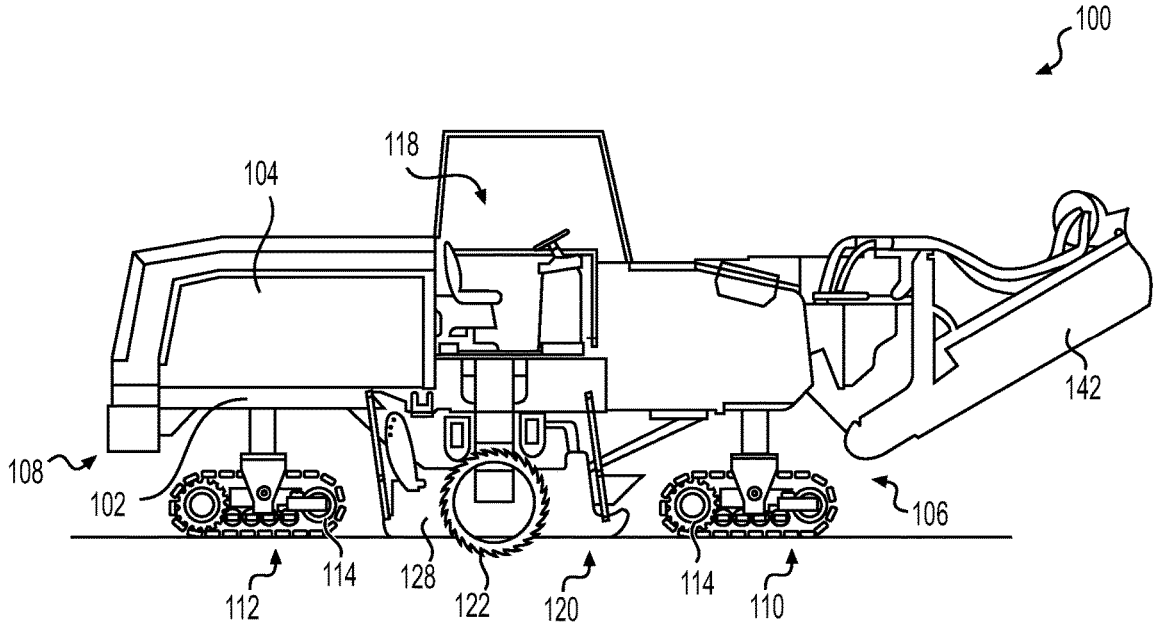
FIG. 1 is a side schematic view of an exemplary machine.
Figure 2:
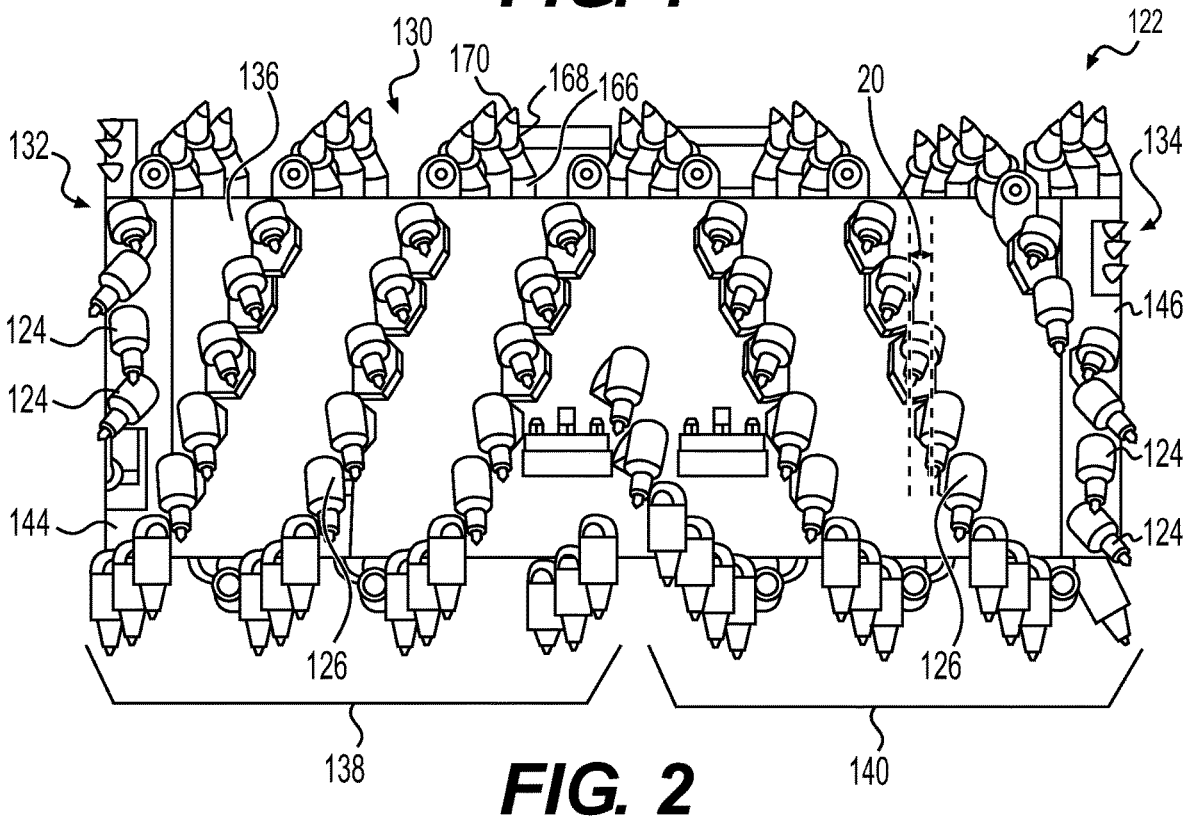
FIG. 2 is a rear view of a rotor of the machine of FIG. 1.

FIG. 1 is a side schematic view of an exemplary machine 100, according to one embodiment of the present disclosure. As shown, machine 100 may be a cold planer. Nevertheless, as mentioned above, this disclosure is not so limited, and machine 100 may be another machine that removes materials from a ground surface or roadbed, such as a rotary mixer, reclaimer, or any milling-type machine. Machine 10 includes a rotor chamber 120 that encloses a rotor 122. As shown in FIG. 2, rotor 122 includes generally cylindrical shell member or drum 130 with a number of cutting assemblies 124, 126 that engage with and help remove material from the ground surface.

Machine 100 has a frame 102. An engine enclosure 104 may be attached to frame 102 and may house an engine (not shown). The engine may be an internal combustion engine and may provide propulsion power to machine 100 and also power various components of machine 100. Machine 100 has a front end 106 and a rear end 108. Front end 106 of machine 100 may have a front drive assembly 110, and rear end 108 may have a rear drive assembly 112. Each of front and rear drive assemblies 110, 112 may include a pair of tracks 114. Tracks 114 may be driven by a hydraulic system of machine 100. Alternatively, machine 100 may include wheels (not shown). Machine 100 may have an operator platform 118. When machine 100 is embodied as a manual or semi-autonomous machine, an operator of machine 100 may sit or stand at operator platform 118 to operate machine 100.

As mentioned, machine 100 includes rotor chamber 120, which may be positioned between front and rear drive assemblies 110, 112. Rotor chamber 120 is an enclosed space defined by a first side plate 128 and a second side plate (not shown) disposed on respective sides of machine 100. Rotor 122 is rotatably coupled to frame 102 and is positioned within rotor chamber 120. Rotor 122 may be positioned between first side plate 128 and the second side plate. Additionally, machine 100 may include a moldboard (not shown) positioned to the rear of rotor 122, for example, to help enclose rotor 122, to direct material from the ground surface away from the ground, and/or to help form a smooth milled surface. In one example, rotor 122 may be a height adjustable rotor.

FIG. 2 illustrates a rear view of rotor 122. As shown in FIG. 2, rotor 122 includes a generally cylindrical shell member or drum 130 having a first edge 132 and a second edge 134. Further, rotor 122 includes a number of cutting assemblies 124, 126 disposed on an outer surface 136 of rotor 122, for example, on an outer surface of drum 130. Cutting assemblies 124 may be coupled to and/or positioned proximate to edges 132, 134 of drum 130, and cutting assemblies 126 may be coupled to a middle portion of drum 130.

In the example shown in FIG. 2, cutting assemblies 126 are spirally-arranged on drum 130. More particularly, cutting assemblies 126 at a first side 138 of rotor 122 are arranged in a clockwise spiral starting from first edge 132 of rotor 122. Moreover, cutting assemblies 126 at a second side 140 of rotor 122 are arranged in a counter-clockwise spiral starting from second edge 134 of rotor 122. This arrangement of cutting assemblies 126, along with the angled arrangement of cutting assemblies 124 on edges 132, 134 of drum 130, may help to allow for movement of removed material to a central portion of rotor 122 from where the removed material may be moved by a conveyor 142 (FIG. 1) to another machine (not shown), such as a truck.

Further, rotor 122 may include a first end ring 144 and a second end ring 146. Cutting assemblies 124 may be coupled to first and second end rings 144, 146. In this example, first and second end rings 144, 146 are coupled at first and second edges 132, 134 of rotor 122, respectively. First and second end rings 144, 146 may be coupled to drum 130 by welding, soldering, brazing, mechanical fasteners, etc.

Figure 3A:
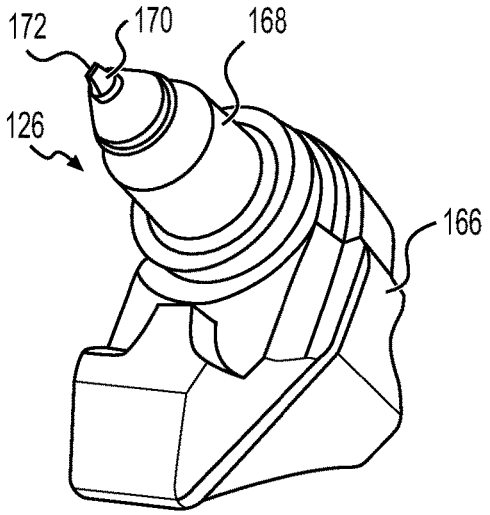
FIGS. 3A-3C are perspective views of a cutting assembly in different configurations.
Figure 3B:
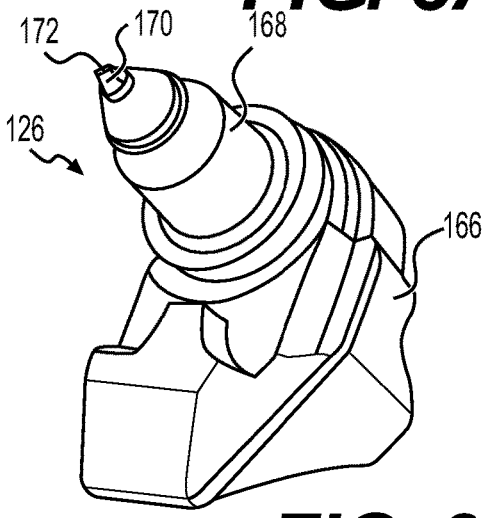
Figure 3C:
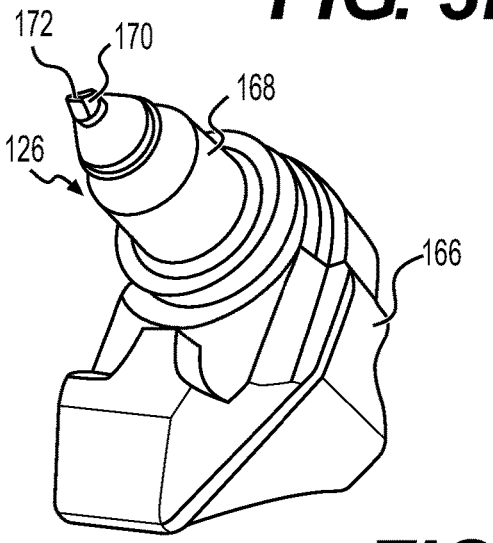

As shown in FIG. 2 and in FIGS. 3A-3C, each cutting assembly 126 includes a tool block 166, a tool holder 168, and a cutting bit 170. For example, tool block 166 may be formed of a metallic material, and may be welded or otherwise fixedly coupled to drum 130. Tool holder 168 may also be formed of a metallic material, and may be received within an opening of tool block 166, for example, secured via an interference fit coupling. Additionally, cutting bit 170 may be brazed or otherwise fixedly coupled to tool holder 168. Cutting bits 170 may be formed of a hard material configured to cut into the ground surface, for example, formed of a carbide-based or diamond-based material. As such, cutting bits 170 may contact the ground surface to engage and remove material. For example, rotor 122 can be lowered so that rotor 122 contacts and cuts the ground surface through force applied by cutting assemblies 126 (e.g., via cutting bits 170) on the ground surface.

As shown in FIG. 2, cutting bits 170 of adjacent cutting assemblies 126 are spaced apart by a distance, or a pitch 20. In one aspect, pitch 20 is the distance between one cutting assembly 126 (e.g., cutting bit 170) and the next closest cutting assembly 126 (e.g., the adjacent cutting bit 170). This distance may be the longitudinal or horizontal distance between adjacent along the outer circumference of drum 130. As discussed in detail below and shown in FIGS. 3A-3C and 4A-4C, adjusting the rotational position or orientation of one or more portions of cutting assemblies 126 may change the pitch between adjacent cutting assemblies 126. In one example, cutting bits 170 of adjacent cutting assemblies 126 are spaced apart by a common pitch, or the same pitch, over the entirety of drum 130.

Figure 4A:
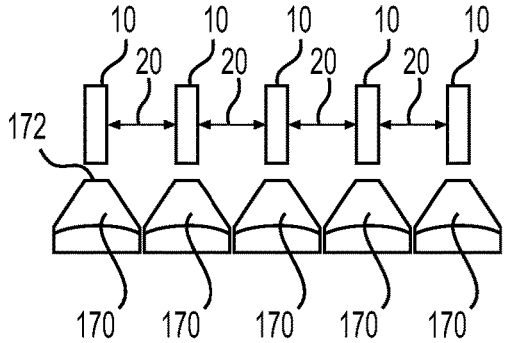
FIGS. 4A-4C illustrate the pitch and/or spacing between cutting bits of cutting assemblies in the configurations of FIGS. 3A-3C.
Figure 4B:
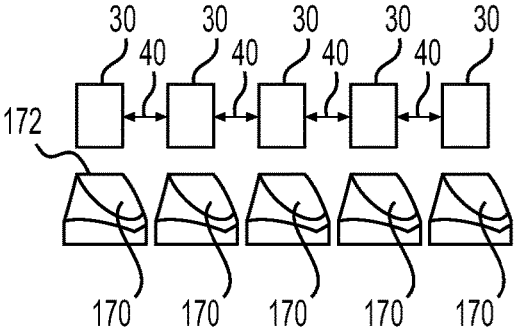
Figure 4C:
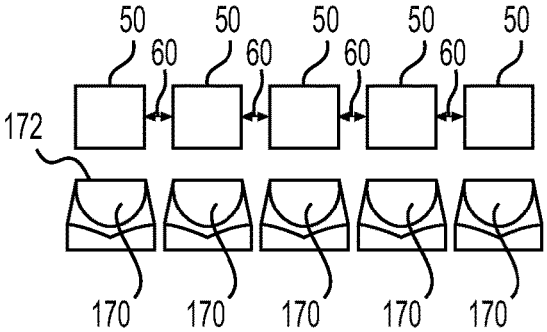

FIGS. 3A-3C illustrate various configurations of one cutting assembly 126, and FIGS. 4A-4C illustrate various pitches between adjacent cutting assemblies 126, or portions of cutting assemblies 126. Additionally, cutting bits 170 may be non-conical and may each include a chisel-shaped tip, for example, having a pair of flat surfaces tapering distally and terminating distally at a distal edge 172. In one aspect, distal edge 172 may include a straight edge (as shown). Even though FIGS. 3A-3C illustrate a single cutting assembly 126, it is noted that the details discussed below with respect to the single cutting assembly 126 may be implemented on all or less than all of the cutting assemblies 126 of rotor 122, for example, to adjust the pitch between adjacent cutting assemblies 126 across the entire rotor 122. In this aspect, the position or orientation of each cutting assembly 126 may be adjusted in order to adjust the pitch between each cutting assemblies 126. Furthermore, aspects discussed herein may also be implemented with respect to cutting assemblies 124 to adjust the pitch between adjacent cutting assemblies 124.

As shown in FIGS. 3A-3C, and as discussed above, cutting assembly 126 includes tool block 166, tool holder 168, and cutting bit 170. FIG. 3A illustrates cutting assembly 126 in a first configuration, and FIG. 4A illustrates a plurality of cutting bits 170 of adjacent cutting assemblies 126 in the first configuration. It is noted that FIGS. 4A-4C show the spirally-arranged adjacent cutting bits 170 of FIG. 2 schematically in a linear arrangement for ease of reference with respect to the pitch or spacing 20. For example, the first configuration may include cutting bits 170 arranged such that distal edge 172 is substantially aligned with a circumference of drum 130. In this aspect, as shown in FIG. 4A, distal edge 172 of cutting bits 170 may form a first cutting width 10 that contacts the ground surface as rotor 122 rotates. Moreover, as shown in FIG. 4A, cutting bits 170 are spaced away from each other by a first pitch 20.

FIG. 3B illustrates cutting assembly 126 in a second configuration, and FIG. 4B illustrates a plurality of cutting bits 170 of adjacent cutting assemblies 126 in the second configuration. For example, the second configuration may include cutting bits 170 angularly rotated approximately 45 degrees such that cutting bits 170 are rotated out of alignment with the circumference of drum 130. In this aspect, distal edge 172 of cutting bits 170 may form a second cutting width 30 that contacts the ground as rotor 122 rotates. Second cutting width 30 is greater than first cutting width 10. Moreover, as shown in FIG. 4B, adjacent cutting bits 170 are spaced away from each other by a second pitch 40, with second pitch 40 being less than first pitch 20.

FIG. 3C illustrates cutting assembly 126 in a third configuration, and FIG. 4C illustrates a plurality of cutting bits 170 of adjacent cutting assemblies 126 in the third configuration. For example, the third configuration may include cutting bits 170 angularly rotated another approximately 45 degrees such that cutting bits 170 are substantially perpendicular to the circumference of drum 130. In this aspect, distal edge 172 of cutting bits 170 may form a third cutting width 50 that contacts the ground as rotor 122 rotates. Third cutting width 50 is greater than second cutting width 30. Moreover, as shown in FIG. 4C, adjacent cutting bits 170 are spaced away from each other by a third pitch 60, with third pitch 60 being less than second pitch 40 and first pitch 20.

First cutting width 10 may be approximately 6 mm. First pitch 20, corresponding to the first configuration of cutting bits 170 shown in FIGS. 3A and 4A, may be approximately 10 mm. Second cutting width 30 may be approximately 10 mm. Second pitch 40, corresponding to the second configuration of cutting bits 170 shown in FIGS. 3B and 4B, may be approximately 6 mm. Third cutting width 50 may be approximately 15 mm. Third pitch 60, corresponding to the third configuration of cutting bits 170 shown in FIGS. 3C and 4C, may be approximately 1 mm.

Pitches 20, 40, 60 may depend on the size of cutting assemblies 126, for example, the size of cutting bits 170. Moreover, cutting widths 10, 30, and 50 and pitches 20, 40, 60 may depend on the number and/or spacings of tool blocks 166 on drum 130, the size of drum 130, etc. For example, cutting assemblies 126 may include a first pitch 20 that is approximately 25 mm. In this example, the second pitch 40 may be approximately 21 mm, and the third pitch 60 may be approximately 18 mm. In another example, cutting assemblies 126 may include a first pitch 20 that is approximately 8 mm. In this example, the second pitch 40 may be approximately 4 mm, and the third pitch 60 may be approximately 1 mm, or less, for example, approximately 0 mm, with adjacent cutting bits 170 in abutting contact or in close proximity to each other. In yet another example, cutting assemblies 126 may include a first cutting width 10 of approximately 1 mm, with a first pitch 20 of approximately 15 mm. In this example, the second cutting width 30 may be approximately 2 mm, with a second pitch 40 of approximately 14 mm, and the third cutting width 50 may be approximately 3.5 mm, with a third pitch 60 of approximately 12.5 mm. Furthermore, it is noted that additional angular rotations of cutting assemblies 126, different sizes of cutting bits 170, different original or initial pitches of cutting assemblies 126, and other aspects of cutting assemblies 126, rotor 122, drum 130, etc. may be implemented to select and/or adjust the cutting widths and pitches as discussed herein. In some aspects, the pitches (and the cutting widths) may be infinitely variable, for example, between a pitch of approximately 15 mm and a pitch of approximately 0 mm. In other aspects, the pitches (and the cutting widths) may be variable between a predetermined number of arrangements, for example, between pitches of approximately 18 mm, approximately 15 mm, approximately 8 mm, approximately 6 mm, approximately 1, and/or approximately 0 mm. For example, the widths of distal edges 172 (i.e., the portion of cutting bits 170 that forms cutting widths 10, 30, and 50) may be approximately equal to, or slightly less than (e.g., 1 mm less), the pitch between cutting assemblies 126.

Figure 6:
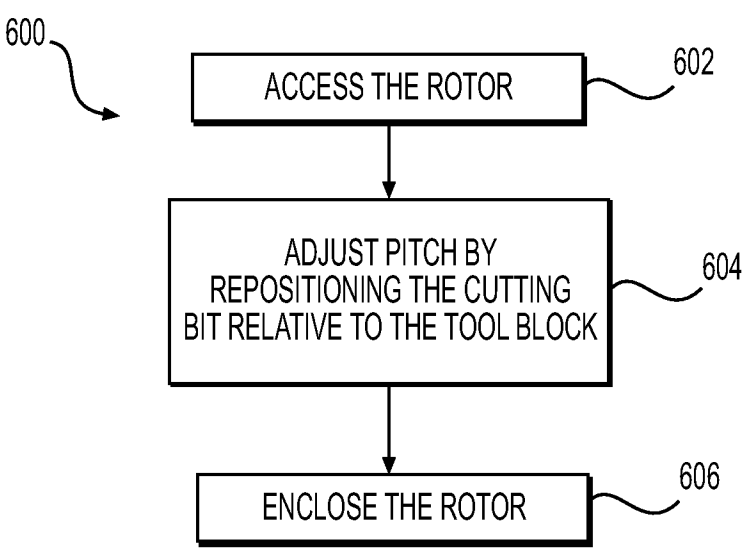
FIG. 6 provides a flow chart depicting another exemplary method for adjusting the orientation of one or more cutting bits of the cutting assemblies.
Figure 5:
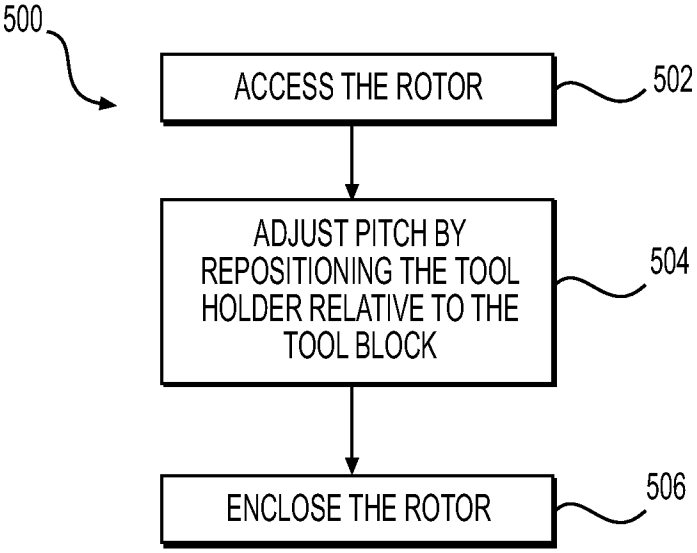
FIG. 5 provides a flow chart depicting an exemplary method for adjusting the orientation of one or more cutting bits of the cutting assemblies.

FIGS. 5 and 6 are flow charts of methods 500 and 600 that may be performed to adjust the orientations and/or positions of one or more portions of cutting assemblies 126, and thus adjust the pitches of adjacent cutting bits 170.

Method 500 includes a step 502 that includes accessing rotor 122. Step 502 may include ending a milling procedure and/or placing machine 100 in an adjustment mode (e.g., engaging a parking brake). In one example, accessing rotor 122 may include opening a side plate (e.g., first side plate 128) and/or a rear moldboard (not shown). Alternatively or additionally, a portion of rotor 122 (e.g., drum 130) may be removed from rotor chamber 120.

Next, method 500 includes a step 504 of adjusting a pitch of one or more cutting assemblies 126 by repositioning tool holder 168 relative to tool block 166. For example, tool holder 168 may be in a first configuration. Repositioning tool holder 168 relative to tool block 166 may include removing tool holder 168 from tool block 166, and then reinserting tool holder 168 into tool block 166 in a second configuration rotationally different from the first configuration. In this aspect, cutting bit 170 remains in the same orientation relative to tool holder 168. Nevertheless, because tool holder 168 is rotationally repositioning relative to tool block 166, cutting bit 170 is repositioned in a second orientation relative to tool block 166, and thus, relative to drum 130.

In one aspect, tool holder 168 may include one or more flat surfaces, for example, on opposing sides of a portion of tool holder 168 that is not inserted into tool block 166, such that a user may use an appropriate tool to turn tool holder 168 relative to tool block 166 to adjust the pitch while maintaining the coupling between the tool holder 168 and tool block 166, for example, by a friction or interference fit. Alternatively or additionally, an auxiliary tool may be used to help remove tool holder 168 from tool block 166. For example, the user may use to auxiliary tool to uncouple tool holder 168 from tool block 166, and then may turn and re-insert tool holder 168 in another rotational orientation to adjust the pitch.

In another example, portions of both tool block 166 and tool holder 168 may include corresponding, mating, or complementary sizes, protrusions, or features that dictate various rotational positions between the tool block 166 and tool holder 168. For example, the tool holder 166 and tool block 168 may include a plurality of flat surfaces that each form, for example, a triangle, a square, a pentagon, a hexagon, etc. For example, an opening in tool block 166 may be square, and a portion of tool holder 168 that is configured to be inserted into tool block 166 may also be square. The corresponding shapes of tool block 166 and tool holder 168 may allow for tool holder 168 to be rotationally positioned within tool block 166 in a number of predetermined orientations. For example, if both tool block 166 and tool holder 168 each include square portions, tool holder 168 may be coupled to tool block 166 in four different orientations.

Adjusting the rotational orientation of tool holder 168 relative to tool block 166 adjusts the orientation of cutting assembly 126 and cutting bit 170 relative to tool block 166, and thus relative to drum 130. Step 504 may include adjusting the orientation of a plurality of tool holders 168 in order to adjust the pitch of a plurality of cutting assemblies 126. For example, all of the cutting assemblies 126 of drum 130 can be rotationally positioned or repositioned to form a uniform or common pitch (20, 40, 60) across the length of the drum 130. In this manner, the cutting widths of cutting bits 170 across drum 130 is also adjusted.

A step 506 includes enclosing rotor 122. For example, step 506 may include closing a side plate (e.g., first side plate 128) and/or a rear moldboard (not shown). Alternatively or additionally, a portion of rotor 122 (e.g., drum 130) may be inserted into rotor chamber 120.

Method 600 includes a step 602 that includes accessing rotor 122. Step 602 may include ending a milling procedure and/or placing machine 100 in an adjustment mode (e.g., engaging a parking brake). In one example, accessing rotor 122 may include opening a side plate (e.g., first side plate 128) and/or a rear moldboard (not shown). Alternatively or additionally, a portion of rotor 122 (e.g., drum 130) may be removed from rotor chamber 120.

Next, method 600 includes a step 604 of adjusting a pitch of one or more cutting assemblies 126 by repositioning cutting bit 170 relative to tool block 166. Step 604 may include repositioning cutting bit 170 relative to tool holder 168 while maintaining the orientation of tool holder 168 relative to tool block 166. In this aspect, the orientation of cutting bit 170 relative to tool block 166, and thus relative to drum 130, is adjusted.

Repositioning cutting bit 170 relative to tool block 166 may include removing a first tool holder 168 (including a first cutting bit 170) from tool block 166, and then reinserting a different, second tool holder 168 (including a second cutting bit 170) into tool block 166. In this aspect, the second tool holder 168 has a cutting bit 170 in a different rotational orientation than the first cutting bit 170 of the first tool holder 168. For example, the first cutting bits 170 may be brazed to the first tool holders 168 in a first orientation, and the second cutting bits 170 may be brazed to the second tool holders 168 in a second orientation. In such an arrangement, the first and second tool holders 168 may be inserted into tool block 166 in the same orientation, but because the second cutting bit 170 is coupled to the second tool holder 168 in a different rotational orientation, the orientation of the second cutting bit 170 relative to tool block 166 is different than the orientation of the first cutting bit 170 relative to tool block 166.

Adjusting the orientation of cutting bit 170 relative to tool block 166 adjusts the orientation of cutting assembly 126 relative to tool block 166, and thus relative to drum 130. Step 604 may include adjusting the orientation of a plurality of cutting bits 170 in order to adjust the pitch of a plurality or all of cutting assemblies 126. For example, all of the cutting assemblies 126 of drum 130 can be rotationally positioned or repositioned to form a uniform or common pitch (20, 40, 60) across the length of the drum 130. In this manner, the cutting widths of cutting bits 170 is also adjusted across all or a portion of the drum 130.

A step 606 includes enclosing rotor 122. For example, step 606 may include closing a side plate (e.g., first side plate 128) and/or a rear moldboard (not shown). Alternatively or additionally, a portion of rotor 122 (e.g., drum 130) may be inserted into rotor chamber 120.

Methods 500 and 600 may be performed for some or all of the cutting assemblies 126 as many times as necessary to adjust the pitches of cutting assemblies 126 in order to perform the desired milling procedures, for example, to yield a desired finish on the ground surface. For example, a first portion of the milling procedure may be performed at a first pitch to yield a first finish on the ground surface, and a second portion of the milling procedure may be performed at a second pitch to yield a second finish on the ground surface. Furthermore, a third portion of the milling procedure may be performed at a third pitch or at the first pitch, for example, to yield either a third finish or the first finish on the ground surface.

Although not shown, the orientation of cutting bits 170 relative to rotor 122 and/or drum 130 may be adjusted other ways. For example, cutting assembly 126 (or cutting assembly 124) may include a locking collar. The locking collar may be adjusted to lock one or more of tool holder 168 and/or cutting bit 170 in different orientations. Similarly, the locking collar may be adjusted to unlock one or more of tool holder 168 and/or cutting bit 170 such that tool holder 168 and/or cutting bit 170 may be repositioned in another orientation, thus adjusting the pitch between adjacent cutting elements 126. In addition, one or more portions of cutting assembly 126 (or cutting assembly 124) may be replaced with another portion of cutting assembly 126 that includes a different cutting width. For example, one or more cutting bits 170 may be replaced with another cutting bit with another orientation and/or cutting width. In one example, cutting bits 170 may have an orientation and/or cutting width such that cutting bits 170 are arranged on drum 130 such that the pitch between adjacent cutting elements 126 is a zero pitch (i.e., a pitch spacing of 0 mm).

Furthermore, one or more of cutting assemblies 126, tool block 166, tool holder 168, and/or cutting bit 170 may include visual indicators to help identify and/or align the respective components in various configurations. For example, in the examples discussed herein where tool holder 168 is adjustable between different rotational configurations relative to tool block 166, tool holder 168 may include an orientation indicator. Tool block 166 may include a plurality of indicators, for example, three indicators. The alignment of the indicator on tool holder 168 with one of the indicators on tool block may be used to help align and/or position tool holder 168 relative to tool block 166. For example, alignment with the first indicator on tool block 166 may correspond to a first rotational orientation of cutting bit 170 and the resulting pitch (e.g., FIGS. 3A and 4A), and alignment with the second indicator on tool block 166 may correspond to a second orientation of cutting bit 170 and the resulting pitch (e.g., FIGS. 3B and 4B). Similarly, alignment with the third indicator on tool block 166 may correspond to a third rotational orientation of cutting bit 170 and the resulting pitch (e.g., FIGS. 3C and 4C).

Although this disclosure discusses adjusting the positions of cutting assemblies 126, this disclosure is not so limited. For example, portions of one or more cutting assemblies 124 on first and second end rings 144, 146 may be adjusted in one or more of the manners discussed herein.

INDUSTRIAL APPLICABILITY

The disclosed aspects of machine 100 may be used in any milling machine to assist in removal of the milled material, while allowing for variations in the spacing, or pitch, between adjacent cutting bits 170 of cutting assemblies 126. For example, the disclosed aspects of machine 100 may allow for the pitch between cutting bits 170 to be adjusted without replacing drum 130 or other portions of rotor 122.

The pitch between cutting bits 170 may affect the ability of rotor 122 to cut and/or remove the ground surface. For example, a larger (or wider) pitch may allow for cutting bits 170 to cut through a harder ground surface, and/or to cut through the ground surface more quickly (e.g., with rotor 122 at a higher rotational speed). Conversely, a smaller (or narrower) pitch may be used for cutting bits 170 to cut through a softer ground surface, and/or to cut through the ground surface more gradually (e.g., with rotor 122 at a lower rotational speed). Accordingly, the effect on the ground surface may be adjusted by adjusting the pitch of cutting bits 170, without replacing drum 130.

Moreover, the pitch between cutting bits 170 may affect the resulting roughness, or finish, of the ground surface. A larger (or wider) pitch may be used for cutting bits 170 to cut through the ground surface quickly, resulting in a rougher finish on the ground surface, for example, because there is more space between cutting bits 170. A smaller (or narrower) pitch may result in a smoother finish (e.g., a micro-finish) on the ground surface, for example, because there is less space between cutting bits 170. Furthermore, an even smaller (or narrower) pitch, for example, a zero pitch, may result in an even smoother finish on the ground surface. As mentioned above, the pitch may be adjusted by rotating cutting bits 170 relative to drum 130, and/or the pitch may be adjusted by replacing one or more portions of cutting assembly 126 (or cutting assembly 124) with another portion of cutting assembly 126 that includes a different cutting width. For example, one or more cutting bits 170 may be replaced with another cutting bit with another orientation and/or cutting width. Accordingly, the resulting roughness, or finish, of the ground surface may be adjusted by adjusting the pitch of cutting bits 170, without replacing drum 130.

Methods 500 and 600 may allow for a user to quickly adjust the position of cutting bits 170, for example, by repositioning tool holder 168 relative to tool block 166. In this manner, the milling properties of rotor 122 may be adjusted quickly without removing drum 130. For example, the user may access rotor 122, for example, by opening a side plate (e.g., first side plate 128 or the second side plate) and/or a rear moldboard. The user may then adjust the orientations of cutting bits 170 to adjust the pitches and cutting widths, as discussed above. The user may then enclose rotor 122 and perform another milling procedure.

It will be apparent to those skilled in the art that various modifications and variations can be made to the disclosed machine without departing from the scope of the disclosure. Other embodiments of the machine will be apparent to those skilled in the art from consideration of the specification and practice of the moldboard support structure disclosed herein. It is intended that the specification and examples be considered as exemplary only, with a true scope of the disclosure being indicated by the following claims and their equivalents.

What is claimed is:

1. A method of adjusting milling properties of a rotor for a milling machine for milling a ground surface, comprising:

accessing the rotor, wherein the rotor includes a drum and a plurality of cutting assemblies, each cutting assembly including a tool block, a tool holder, and a cutting bit, the cutting bit having a chisel-shaped tip with a distal edge;

adjusting a rotational orientation of a plurality of cutting bits and tool holders relative to the corresponding tool blocks, thereby changing an angular orientation of the chisel-shaped tip and changing a cutting width of the distal edge that contacts the ground surface; and enclosing the rotor.

2. The method of claim 1, wherein adjusting the rotational orientation of the plurality of cutting bits and tool holders relative to the corresponding tool blocks includes rotating the tool holders relative to the tool blocks.

3. The method of claim 2, wherein rotating the tool holders relative to the tool blocks includes uncoupling the tool holders from the tool blocks and then coupling the tool holders to the tool blocks in a different rotational orientation.

4. The method of claim 3, wherein the tool holders are interference fit to a portion of the tool blocks, and wherein rotating the tool holders relative to the tool blocks includes uncoupling the tool holders from the tool blocks to break the interference fit, and inserting the tool holders into the tool blocks to form a new interference fit with the tool holders in the different rotational orientation.

5. The method of claim 1, wherein the cutting assemblies are spirally-arranged around the drum of the rotor such that adjacent cutting bits are spaced apart by a pitch.

6. The method of claim 5, wherein the pitch is adjustable between approximately 15 mm and approximately 0 mm based on the rotational orientation of the cutting bits relative to the tool blocks.

7. The method of claim 5, wherein adjusting the rotational orientation of a plurality of cutting bits and tool holders relative to the corresponding tool blocks includes adjusting the cutting bits and tool holders of the cutting assemblies such that the cutting bits are each spaced apart by a common pitch.

8. A milling system for a milling machine for milling a ground surface, comprising:

a rotor including a drum; and a plurality of cutting assemblies coupled to the drum, wherein each of the cutting assemblies includes a tool block, a tool holder, and a cutting bit, the cutting bit having a chisel-shaped tip with a distal edge, wherein the chisel-shaped tip of the cutting bits between adjacent cutting assemblies are spaced apart by a pitch, and wherein the pitch is adjustable between at least a first configuration and a second configuration by adjusting a rotational orientation of one or more of the tool holder or the cutting bit relative to the tool block to change a cutting width of the distal edge of the chisel-shaped tip that contacts the ground surface.

9. The milling machine of claim 8, wherein the first configuration includes a pitch of approximately 10 mm, and wherein the second configuration includes a pitch of approximately 6 mm.

10. The milling machine of claim 8, wherein the tool blocks are welded to the drum, and wherein the cutting bits are brazed to the tool holders.

11. The milling machine of claim 10, wherein the tool holders are interference fit within a portion of the tool blocks.

12. The milling machine of claim 8, further comprising a rotor enclosure, including at least one side door or a moldboard.

13. A method of adjusting milling properties of a rotor for a milling machine for milling a ground surface, comprising:

accessing the rotor, wherein the rotor includes a drum and a plurality of cutting assemblies, each cutting assembly including a tool block, a tool holder, and a cutting bit, the cutting bit having a chisel-shaped tip with a distal edge;

adjusting a rotational orientation of a plurality of cutting bits relative to the corresponding tool blocks, thereby changing an angular orientation of the chisel-shaped tip and changing a cutting width of the distal edge that contacts the ground surface; and enclosing the rotor.

14. The method of claim 13, wherein adjusting the orientation of the cutting bits relative to the tool blocks includes replacing the cutting bits and the tool holders with second cutting bits and second tool holders.

15. The method of claim 14, wherein each cutting bit is brazed to the corresponding tool holder.

16. The method of claim 15, wherein the tool holders are interference fit to a portion of the tool blocks, and wherein replacing the cutting bits and the tool holders with the second cutting bits and the second tool holders includes breaking the interference fit.

17. The method of claim 13, wherein the cutting assemblies are spirally-arranged around the drum of the rotor such that adjacent cutting bits are spaced apart by a pitch.

18. The method of claim 17, wherein the pitch is adjustable between approximately 15 mm and approximately 0 mm based on the rotational orientation of the cutting bits relative to the tool blocks.

19. The method of claim 17, wherein adjusting the rotational orientation of the plurality of cutting bits relative to the corresponding tool block includes adjusting the cutting bits of the cutting assemblies such that the cutting bits are each spaced apart by a common pitch.

20. The method of claim 13, wherein accessing the rotor includes lifting a side door or a moldboard, and wherein enclosing the rotor includes closing the side door or the moldboard.

21. A milling system for milling a ground surface with a milling machine, comprising:

a rotor including a drum; and a plurality of cutting assemblies, wherein each of the cutting assemblies includes a tool block, a tool holder, and a cutting bit, the cutting bit having a chisel-shaped tip with a distal edge, wherein a rotational orientation of a plurality of cutting bits and tool holders relative to the corresponding tool blocks can be adjusted to change an angular orientation of the chisel-shaped tip, thereby changing an angular orientation of the chisel-shaped tip and changing a cutting width of the distal edge that contacts the ground surface;

wherein, with the cutting assemblies coupled to the drum, the cutting bits between adjacent cutting assemblies are spaced apart by a pitch, and wherein the pitch is adjustable between at least a first configuration and a second configuration, wherein one of the first configuration or the second configuration includes a pitch of zero.

* * * * *